United States Patent [19]

Connor

[11] 4,363,438

[45] Dec. 14, 1982

[54] MAIL BOX

[76] Inventor: Charlie Connor, Roxbury, Boston, Mass. 02119

[21] Appl. No.: 166,398

[22] Filed: Jul. 7, 1980

[51] Int. Cl.[3] ..... B65D 91/00

[52] U.S. Cl. ..... 232/30; 232/38; 232/43.2

[58] Field of Search ..... 232/30, 31, 32, 17, 232/38, 43.1, 43.2; 248/99

[56] References Cited

U.S. PATENT DOCUMENTS

| | | | |
|---|---|---|---|
| 60,233 | 12/1866 | Nolt | 248/99 |
| 363,780 | 5/1887 | Wright et al. | 248/100 X |
| 461,381 | 10/1891 | Richter | 232/30 |
| 1,160,820 | 11/1915 | Baur | 232/43.2 |
| 1,451,343 | 4/1923 | Panagopolous | 232/31 |
| 2,314,639 | 3/1943 | West et al. | 248/99 X |
| 2,421,221 | 5/1947 | Rothe | 232/30 |
| 2,804,263 | 8/1957 | Fonde | 232/17 X |
| 3,005,994 | 10/1961 | Heil | 248/99 X |
| 3,982,690 | 9/1976 | Krizan et al. | 232/17 |

*Primary Examiner*—Roy D. Frazier
*Assistant Examiner*—Peter A. Aschenbrenner
*Attorney, Agent, or Firm*—Walter J. Kreske

[57] ABSTRACT

An improved mail box structure incorporating existing Postal Service mail boxes for facilitating collection of mail contents thereof in a dry condition even in stormy weather and is comprised of an existing mail box of the self standing type and having internally thereof a mailbag holding frame for holding the mailbag in open position for receiving mail deposited through the existing mail receiving pivotal door chute, baffles extending downwardly from the mail box wall toward the mailbag holding frame for deflecting all received mail into the open mailbag held on the mailbag holding frame which is carried on a horizontally disposed slide structure fixed to the side walls of the mail box and positioned for slidably moving the mailbag holding frame with the mailbag held thereon forwardly through the existing mail collection door opening when the mail collection door is in open position.

4 Claims, 9 Drawing Figures

MAIL BOX

BACKGROUND OF THE INVENTION (1) Field of the Invention

A mail box structure incorporating existing mail boxes for facilitating collection of mail contents thereof in dry condition even in stormy weather.

(2) Description of the Prior Art

The self standing mailboxes set out by the Postal Service on community streets for receiving citizen mail have two serious deficiencies. One of these deficiencies is that the mail box structure inherently requires of a mail collector the relatively cumbersome, time consuming and expensive chore of transferring by hand the mail from the mail box to a canvas mail collection bag. The other and more serious deficiency is that during stormy weather this hand transfer operation of mail from the mail box to the mail collector's canvas mail collection bag results in the mail being exposed to rain or snow which thereby often results in the mail becoming sufficiently wet to cause subsequent malfunction of postal mail servicing machinery, particularly the machinery which mechanically sorts the mail, and results in costly downtime.

There have been some inventions which sought to solve these deficiencies by incorporating a bag receptacle in a mail box in position to receive the mail as it is deposited in the mail box. These devices have in general not been compatible with existing mail boxes and would involve costly scrapping of the present large inventory of mail boxes in use and apparently do not have sufficient merit to warrant the expense.

SUMMARY OF THE INVENTION

The above problems have been overcome by the present invention which eliminates the need for replacing the existing mail boxes in that they are incorporated as part of the present invention which includes structure capable of being relatively easily added directly to the existing mail boxes in manner to form with the existing mail boxes a new combination having the attributes of utilizing existing canvas mailbags as receptacles for directly receiving the mail as it is deposited in the mail box and the convenience of easily and rapidly removing the entire mailbag with its mail contents from the mail box without the mail collector having to manually handle individual pieces of mail.

A primary object of the present invention is the provision of a mail box combination which readily lends itself to incorporation with existing mail box structures to greatly increase the speed and efficiency of the mail box collection function by the mail collector.

A further object is the provision of a mail box combination which has capacity for utilizing existing mailbags for performing their mail collection function in a more efficient manner.

And another object is the provision of a mail box combination which makes possible the removal of the mail contents of the mail box even during stormy weather without the mail getting wet.

These objects, features and advantages of the present invention are achieved generally by providing at the side walls inside the mail box horizontally disposed slide means carrying a mailbag holding frame adapted for holding a mailbag in open position beneath the lower section of the mail receiving chute and with the slide means arranged for permitting movement of the mailbag holding frame forwardly to a position above the mail collection door when the door is in open position, and baffles about the insides of the walls above the mailbag holding frame and below the lower section of the mail chute and having deflection members extending downwardly from the walls to a position overlapping the open end of the mailbag held by the mailbag holding frame.

A particularly suitable slide means structure includes at each of the side walls horizontally disposed channel slide members extending rearwardly from the forward to the rear edge of the associated mail box side wall and a pair of elongated horizontally disposed flat side members on opposite sides of the mailbag holding frame and extending laterally in operating relation to the associated channel slide members for permitting movement of the mailbag holding frame through the mail collection door opening.

A particularly suitable configuration for the mailbag holding frame is that of vertical sides fixed to the flat slide members and having an opening for receiving the open end of the mailbag and including an arrangement for holding the open end of the mailbag in open position at the vertical sides.

An effective arrangement for holding the open end of the mailbag in open position at the vertical sides of the mailbag holding frame is the provision of an outward flare at the top of the vertical sides which when overlapped by the open end of the mailbag may hold the mailbag firmly in place by tightening the mailbag drawstring.

These features, objects and advantages will be better understood from the following description taken in connection with the accompanying drawings illustrating a preferred embodiment of the invention.

DETAILED DESCRIPTION OF THE PREFERRED EMBODIMENT

Figures 1, 2, 3, 4, 5, 6, 7, 8, 9:
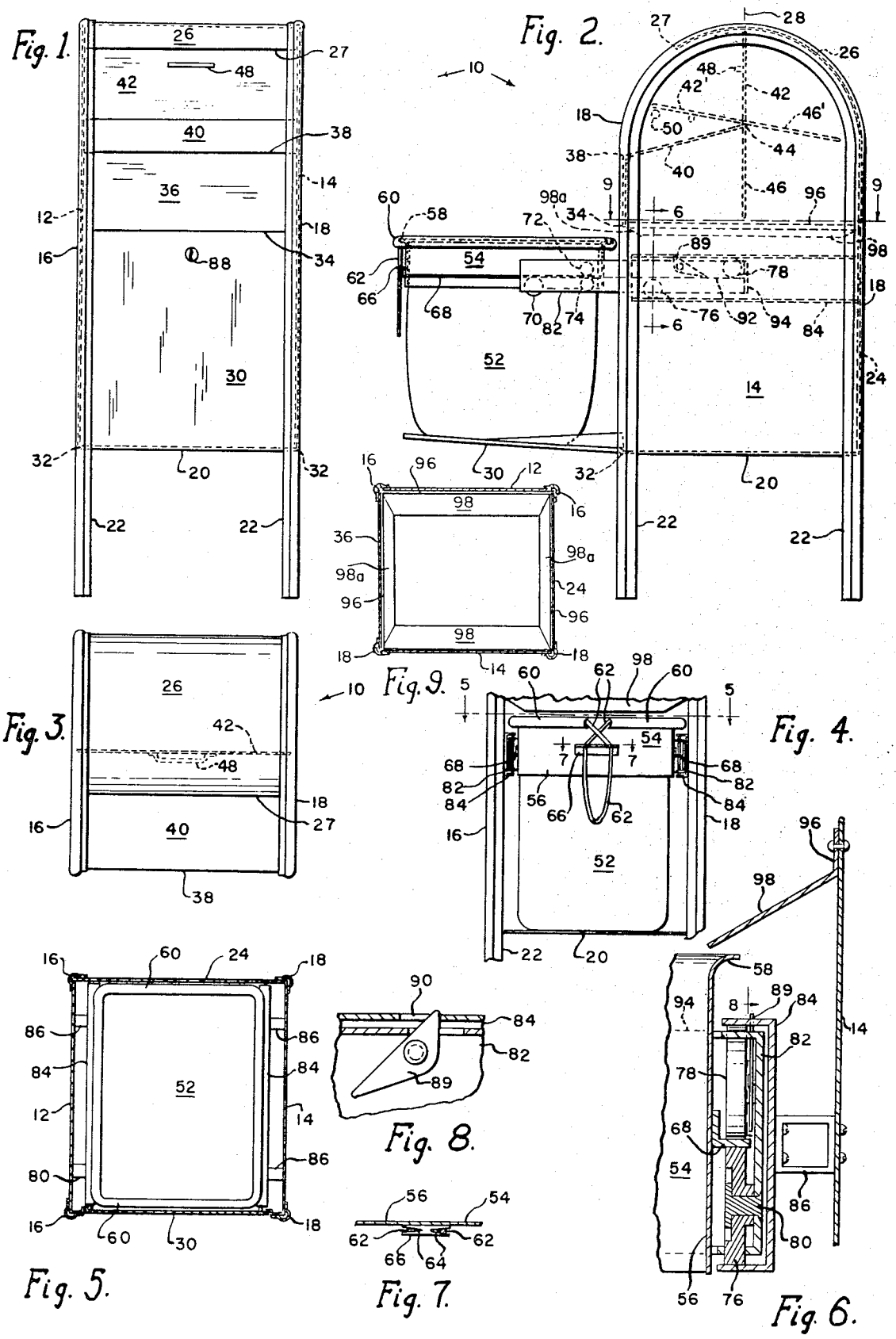
FIG. 1 is a front view of a mailbox forming part of the combination in the present invention.
FIG. 2 is a side view of the FIG. 1 illustration with the mail collection door shown in open position and suspended over which is a mailbag held by a mailbag holding frame carried on a slide structure in accordance with the present invention.
FIG. 3 is a top view of the FIG. 1 illustration.
FIG. 4 is a front view of a portion of the FIG. 1 illustration with the mail collection door removed to more clearly show construction and operation of the present invention.
FIG. 5 is a cross sectional view taken on line 5—5 of FIG. 4.
FIG. 6 is a cross sectional view to enlarged scale taken on line 6—6 of FIG. 2 with the mailbag holding frame in place inside the mail box and the mailbag removed therefrom.
FIG. 7 is a cross sectional view taken on line 7—7 of FIG. 4 to more clearly show construction of the mailbag drawstring holding structure.
FIG. 8 is a view taken on line 8 of FIG. 6 to more clearly show construction of the slide latch.
FIG. 9 is a view taken on line 9—9 of FIG. 2 to more clearly show the baffles.

A mail box configuration in accordance with the present invention is designated generally by the numeral 10 and has a housing structure like that of existing Postal Service mail boxes. It is comprised of a pair of sidewalls 12 and 14 with semicircular upper ends and straight bottom ends and fastened at their forward and rear edges to angled and curved support members 16 and 18 respectively. The support members 16 and 18 project below a bottom wall 20 to form legs 22 for holding the mail box housing above the terrain. The bottom wall 20 extends to the bottom edges of the side walls 12 and 14. The mailbox 10 has a rear wall extending upwardly from the rear edge of the bottom wall 20 and between the rear edges of the side walls 12 and 14. The mailbox 10 also has a top wall portion 26 extending upwardly and forwardly from the rear wall 24 along the semicircular upper ends of the side walls 12 and 14 and terminating at 27 slightly forward of a plane 28 passing vertically through the center of the semicircular upper ends of the side walls 12 and 14.

A mail collection door 30 is mounted at its bottom edge to pivot at the forward edge 32 of the bottom wall 20 and extends upwardly between the forward edges of the side walls 12 and 14 to the bottom edge 34 of a front wall 36 between a portion of the forward edges of the side walls 12 and 14. The front wall 36 extends upwardly to the forward edge 38 of a top wall forward portion 40 which extends rearwardly at an upward inclination terminating below and rearwardly of the forward edge 27 of the top semicircular top wall 26.

A normally vertical closure member 42 is pivoted at the rear edge 44 of the top wall forward portion 40 and is of a width extending from one side wall 12 to the other side wall 14 and has a lower section 46 which with the upper section 42 forms a mail receiving chute. The upper section 42 of the mail receiving chute has a handle for facilitating manual forward movement of the mail chute 42 to a stop pin 50 as shown by broken lines 42' and 46' in FIG. 2 so that mail may be inserted for passage to the interior of the mail box 10 when the chute members 42 and 46 return to the vertical position.

A mailbag 52 is held with its open end in receiving relation to the mail coming down the receiving mail chute members 42 and 46 by a mailbag holding frame 54 having vertical sides such as 56. The upper edges of the sides of the holding frame 54 have an outward flare 58 so that the casing or hem 60 at the open end of the mailbag 52 may be positioned to overlap the flare 58 and the pull cord or drawstring 62 tightened beneath the flare 58 so as to securely hold the mailbag 52 in place in open position beneath the lower section 46 of the mail chute. The drawstring 62 may then be locked in place by wedging it firmly in the V shaped slots 64 on the respective ends of the bracket 66 which is fixed to the mailbag holding frame 54. In place of a casing or hem 60, the mailbag 52 may have conventional eyelets or grommets through which the drawstring 62 operates in substantially the same manner as with the hem 60.

Horizontally disposed elongated flat slide members 68 are fixed by flanges to opposite sides of the mailbag holding frame 54 and extend laterally into operating engagement with slide wheels 70, 72, 74, 76 and 78 rotatively mounted on wheel mounting pins such as 80 fixed to an elongated horizontally disposed inner slide channel 82 carried in a horizontally disposed outer slide support channel 84 held in place on the associated side walls 12 and 14 by brackets 86. The slide wheel 78 makes contact with the upper flange of the channel 84, while the slide wheel 76 makes contact with the lower flange of the channel 84 for thereby permitting easy horizontal movement of the inner slide channel 82. The slide wheels 70 and 74 make contact with the underside of the elongated flat slide member 68, while the slide wheel 72 makes contact with the upper side of the elongated flat slide member 68 and thereby permit easy horizontal movement of the holding frame 54 for movement of the mailbag 52 laterally into the interior of the mailbox 10 so that the open end of the mailbag 52 will be directly beneath the lower section 46 of the mail chute.

When the mailbag 52 and its mail contents are desired to be removed from the mail box 10, the door 30 is unlocked with an appropriate key inserted in a conventional lock 88 and the door lowered to the open position shown in FIG. 2, whereupon the holding frame 54 with its mailbag 52 held thereon is manually pulled forwardly through the door opening until movement of the slide channel 82 is stopped by engagement of pivotally mounted latch 89 with the support channel 84 through an opening 90 as shown in FIG. 8, and the forward movement of the mailbag holding frame 54 is stopped by a flexible cord (shown by broken lines 92 in FIG. 2) which has one end fixed to the mailbag holding frame 54 and the other end fixed to a cross bar 94 rigidly fixed to the rear ends of the pair of slide channels 82. The mailbag 52 will then be in the position shown in FIG. 2.

The mailbag 52 may be released from the holding frame 54 by first releasing the drawstring 62 from the V grooves 64 of the bracket 66 by lateral hand pressure and then removing the open end of the mailbag 52 from the flare 58 whereupon the mailbag 52 may be closed by again tightening the drawstring 62 in the hem 60 in conventional manner and lifted away from the mailbox 10. An empty mailbag may then be attached to the mailbag holding frame 54 in manner explained above and the mailbag holding frame 54 with the newly attached mailbag thereon may be manually pushed back into place in the mailbox 10 and the door 30 closed and locked for again receiving mail through the chute members 42 and 46.

Baffles 96 (FIGS. 2, 4, 6 and 9) are fixed to each of the walls inside the mailbox 10 and have deflection members 98 extending downwardly from the respective walls beneath the lower section 46 of the mail chute to a position overlapping the upper end of the mailbag holding frame 54 as shown in FIG. 6 to insure that mail received from the mail chute sections 42 and 46 are always deflected into the open end of the mailbag 52 carried in the mailbag holding frame 54. It will be noted from the broken lines in FIG. 2 and the plan view in FIG. 9 that the baffles 96 require broader width deflection members 98 at the sides 12 and 14 than deflection members **98*a* at the back and front walls 24 and 36 because the mailbag 52 and holding frame 54 are closer to the back and front walls 24 and 36 than to the side walls 12 and 14. The baffles 96 may be fixed to the wall of the mailbox 10 by rivets such as shown by the rivet 99 in FIG. 4**.

What is claimed is:

1. In a mail box a pair of side walls with substantially semicircular upper ends, straight bottom ends and vertical forward and rear edges; a bottom wall extending horizontally between the bottom edge portions of the side walls; a rear wall extending vertically up between the rear edge portions of the side walls and a top wall extending from the rear wall upwardly and forwardly along the semicircular ends of the side walls and terminating slightly forward of a plane passing vertically through the center of said semicircular upper ends, a door pivoted at the forward edge of said bottom wall and extending upwardly between the front edges of the side walls to the bottom edge of a front wall between forward edge portions of the side walls; a top wall front portion extending rearwardly from the top edge of the front wall at an upward inclination and terminating below and rearwardly of the forward edge of the top wall, a normally vertical closure member pivoted at the rear edge of the top wall front portion and having an upper and lower sections forming a mail receiving chute, said upper section being of a width to extend from one side wall to the other; horizontally disposed slide means inside said mail box at each of said side walls; mailbag holding means comprised of a rigid frame carried by and between the respective ones of said slide means and having an opening for receiving the upper portion of a mailbag and adapted for removeably holding said mailbag in open position in said opening and beneath said closure member lower section, said slide means having capacity for movement and support of said mailbag holding means with said mailbag held thereon forwardly to a position substantially completely outside of said mailbox when said door is in open position; and baffles at the side, front and rear walls above said mailbag holding means and below said closure member lower section and having deflection members extending downwardly from said walls to a position overlapping the opening of said mailbag.

2. In a mail box as in claim 1 wherein said slide means includes at each of the side walls horizontally disposed an inner and outer channel slide members extending rearwardly from the forward to the rear edge of the associated side walls, and elongated horizontally disposed flat slide members on opposite sides of said mailbag holding means and extending laterally into operating relation with respect to associated ones of said inner channel members which are each in cooperative relation to the respective outer channel member for providing said capacity for movement of said mailbag holding means.

3. In a mail box as in claim 2 wherein said mailbag holding means rigid frame has vertical sides about said opening for receiving the mailbag, and includes means for removeably holding the open end of the mailbag in open position at said vertical sides.

4. In a mail box as in claim 3 wherein said means for holding the open end of said mailbag at said vertical sides is comprised of an outward flare at the top of said mailbag holding frame vertical sides for overlap by the open end of said mailbag to hold said mailbag in removeable position on said rigid frame.

* * * * *